US012474047B2

(12) United States Patent
Li et al.

(10) Patent No.: US 12,474,047 B2
(45) Date of Patent: Nov. 18, 2025

(54) BURNER AND APPLICATIONS THEREOF

(71) Applicant: DALIAN INSTITUTE OF CHEMICAL PHYSICS, CHINESE ACADEMY OF SCIENCES, Liaoning (CN)

(72) Inventors: Weizhen Li, Liaoning (CN); Jingcai Zhang, Liaoning (CN); Tao Zhang, Liaoning (CN)

(73) Assignee: DALIAN INSTITUTE OF CHEMICAL PHYSICS, CHINESE ACADEMY OF SCIENCES, Liaoning (CN)

( * ) Notice: Subject to any disclaimer, the term of this patent is extended or adjusted under 35 U.S.C. 154(b) by 418 days.

(21) Appl. No.: 18/002,162

(22) PCT Filed: Nov. 29, 2021

(86) PCT No.: PCT/CN2021/133947

§ 371 (c)(1),
(2) Date: Dec. 16, 2022

(87) PCT Pub. No.: WO2022/096021

PCT Pub. Date: May 12, 2022

(65) Prior Publication Data

US 2023/0349549 A1 Nov. 2, 2023

(30) Foreign Application Priority Data

Nov. 3, 2020 (CN) ..... 202011212593.x
Nov. 3, 2020 (CN) ..... 202022507320.x

(51) Int. Cl.
*F23D 14/02* (2006.01)
*F23C 6/02* (2006.01)
(Continued)

(52) U.S. Cl.
CPC ..... *F23D 14/02* (2013.01); *F23C 6/02* (2013.01); *F23D 14/26* (2013.01); *F23D 14/62* (2013.01); *F24C 3/082* (2013.01); *F23D 2213/00* (2013.01)

(58) Field of Classification Search
CPC ..... F24C 3/082; F23D 14/62; F23D 14/26; F23D 14/02; F23D 14/145; F23D 14/70; F23C 6/06
(Continued)

(56) References Cited

U.S. PATENT DOCUMENTS

2004/0126727 A1 7/2004 Cho et al.
2004/0161717 A1* 8/2004 Suzuki ..... F23D 11/402 431/170
2009/0226854 A1* 9/2009 Ojiro ..... F23D 14/78 431/351

FOREIGN PATENT DOCUMENTS

CN 2596231 Y 12/2003
CN 101046290 A 10/2007
(Continued)

*Primary Examiner* — Vivek K Shirsat
(74) *Attorney, Agent, or Firm* — NKL Law; Allen Xue

(57) ABSTRACT

A burner includes a housing, a fan, a burning head and an ignition mechanism. An air inlet of the housing and an input end of the burning head form a pressure equalizing cavity. The ignition mechanism is arranged at an output end of the burning head. The burning head includes a main frame and at least one stable burning isolation strip, an interior of the main frame is divided into at least two ventilation areas by the stable burning isolation strip in a gas channel direction. A plurality of separation mechanisms is arranged in each ventilation area and divide the ventilation area into a plurality of through holes arranged in the gas channel direction, the through holes are used for allowing mixed gas to pass through and strengthening the mixing effect. The burning flame of a burning surface of the main frame can be divided
(Continued)

into mutually independent flames by the stable burning isolation strip. The burner can be used in gas stoves, low-nitrogen combustion engines for a gas boiler, gas water heaters and gas heating water heaters.

8 Claims, 9 Drawing Sheets

(51) Int. Cl.
*F23D 14/26* (2006.01)
*F23D 14/62* (2006.01)
*F24C 3/08* (2006.01)

(58) Field of Classification Search
USPC ..... 431/326, 354
See application file for complete search history.

(56) References Cited

FOREIGN PATENT DOCUMENTS

| | | | |
|---|---|---|---|
| CN | 108006629 | A | 5/2018 |
| CN | 208871625 | U | 5/2019 |
| CN | 211261292 | U | 8/2020 |
| CN | 112128805 | A | 12/2020 |
| CN | 112212327 | A | 1/2021 |
| CN | 112212328 | A | 1/2021 |
| CN | 213577479 | U | 6/2021 |
| CN | 213577600 | U | 6/2021 |
| CN | 213578067 | U | 6/2021 |
| CN | 213578068 | U | 6/2021 |
| CN | 214249581 | U | 9/2021 |
| CN | 214275834 | U | 9/2021 |
| CN | 214581061 | U | 11/2021 |
| TW | M545219 | U | 7/2017 |
| WO | 2010073282 | A1 | 7/2010 |

* cited by examiner

| | Gas water heater /wall-hanging | Gas stove | Gas boiler Burning machine | Flame form | Color | Emission |
|---|---|---|---|---|---|---|
| Traditional burner | 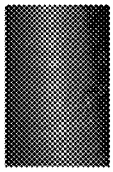 | 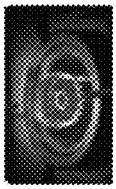 | 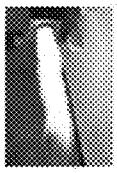 | Long outer flame and short inner flame | Blue (azure, whitish) with high air-fuel ratio; yellow with low air-fuel ratio | $NO_x > 140$ mg/Nm$^3$<br>$CO > 200$ ppm |
| Full-premixed surface burner | 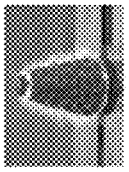 | 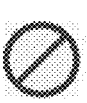 | 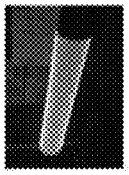 | Only short inner flame | Blue (azure, whitish) | $NO_x < 30$ mg/Nm$^3$<br>$CO < 30$ ppm |
| Infrared burner | 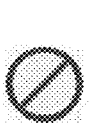 | 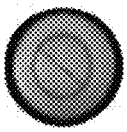 | 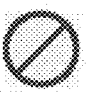 | No obvious flame | Red | ===== ==== |
| Blue flexible burner | 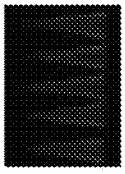 | 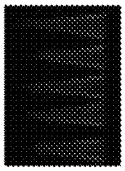 | 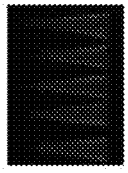 | Only long outer flame | Blue | $NO_x < 15$ mg/Nm$^3$<br>$CO < 10$ ppm |

Fig. 11

BURNER AND APPLICATIONS THEREOF

TECHNICAL FIELD

The present disclosure relates to the technical field of combustion apparatuses, in particular to a burner and use thereof.

BACKGROUND ART

Burner is a general name for devices injecting fuel and air in a certain manner for mixed burning. Burners are divided into industrial burners, burning machines, civil burners and special burners according to types and application fields. The burners commonly used at home include gas boilers, gas stoves, high-fire gas stoves, infrared gas stoves, and burning heads of gas water heaters.

The gas boiler has the power of 200 kW or more, fuel gas is sprayed out of a small hole and mixed with air blown into a large barrel by a fan, and then is ignited to form an integral cylindrical conical flame. As for a traditional burning head, fuel gas is mixed with air in a burning disc and ignited, which belongs to diffusion flame burning. The traditional burning head has simple structure, mature technology, low cost, but the high CO and $NO_x$ emission concentration. A main body of a full-premixed metal fiber surface burning head is a temperature-resistant metal fiber net and needs to cooperate with a full-premixed fan and a valve group for use, which shortens a flame length to avoid a local high temperature and shorten burning time, so as to reduce nitrogen. As for this surface burning head, although the CO and $NO_x$ emission concentration is low, but the cost is high and has defects such as burner blocking and tempering risks. A staged burning head (bias burning head) introduces air or fuel into a furnace in multiple stages to burn, which generates a reducing atmosphere to reduce generated $NO_x$ into $N_2$, so as to reduce nitrogen. The staged burning head has relatively complex structure, mature technology, high cost, limited nitrogen reduction effect (ultralow emission is difficult to achieve), and high CO emission concentration.

The gas stove has the power of 3-5 kW. After pipeline fuel gas ejects air, a mixing gas of fuel gas and air is ejected from small holes arranged at an inner disc and an outer ring, and flame is divided into two layers after ignition: a rich-burning premixed burning flame is formed inside by the fuel gas and the ejected air, and a diffusion burning flame is formed outside by residual fuel and ambient air. As for a traditional cooking range, fuel gas ejects primary air into a cooking range structure for mixing, and premixed gas is ignited followed by contacting with secondary air through diffusion to complete a burning process. The traditional cooking range has simple structure, mature technology, low cost, but low heat efficiency and high CO and $NO_x$ emission concentration. A burning disc of the infrared gas stove is a porous ceramic plate, fuel gas ejects air into a cooking range for mixing, and the ceramic disc is heated through flame burning to be converted into infrared burning. However, ceramic is prone to damage, insufficient combustion gas easily causes insufficient burning, the cost is high, the heat efficiency is high, and the $NO_x$ and CO emission concentration is high. The cooking range structure of the high-fire gas stove is not special and requires high fuel gas pressure, and combustion air is generally supplied by ejection or a fan. The high-fire gas stove has simple structure, the mature technology, low cost, but low heat efficiency and high CO and $NO_x$ emission concentration.

The high-fire gas stove has the power of 5-30 kW. After being mixed in a pipeline, pipeline fuel gas and air blown out by a fan are sprayed out from holes arranged in an inner disc and an outer ring and are ignited to form an oxygen-enriched flame with high fire power and temperature, but the mixed gas burn insufficiently and CO and $NO_x$ emission concentration is high.

The infrared gas stove has the power of 3-5 kW. After pipeline fuel gas ejects air and is ignited from an upper surface of a honeycomb disc, the flame retracts into the honeycomb channels for short-flame burning, and the honeycomb body is heated to form a high-temperature heat accumulator to emit infrared rays for heating. Infrared burner is basically the same as the infrared gas stove in structure and features and mainly carries out burning in a channel, its power is limited and the structure is prone to damage.

The water heater and the wall-hanging stove have the power of 20-70 kW. Fuel gas and part of air blown by a fan enter a fire grate and then are sprayed out from small holes, a rich-burning premixed cluster flame is formed after ignition, and fuel which is not completely burned and the remaining part of air sprayed out through gaps of the fire grate continue to be diffused and burned. As for a traditional tobacco pipe type fire grate, fuel gas ejects primary air into a tobacco pipe structure for mixing, and premixed gas is ignited followed by contacting with secondary air by means of diffusion so as to complete a burning process. It has simple structure, mature technology, low cost, but high CO and $NO_x$ emission concentration. The structure of a bias fire grate is similar to the tobacco pipe type fire grate, which makes a reducing atmosphere through staged burning to reduce $NO_x$ into $N_2$ so as to reduce nitrogen. It has complex structure and high cost; although the $NO_x$ emission concentration is low, the CO emission concentration is high. A water-cooled fire grate is mainly a combination of a traditional fire grate and a water-cooled copper pipe, which reduces the flame temperature through heat exchange to reduce nitrogen. It has mature technology low $NO_x$ emission concentration, but high cost, complex structure and high CO emission concentration. A main body of a full-premixed metal fiber surface burner is a temperature-resistant metal fiber net and needs to cooperate with a full-premixed fan and a valve group for use, which shortens a flame length to avoid a local high temperature and shorten burning time, so as to reduce nitrogen. It has low CO and $NO_x$ emission concentration, but has defects such as high cost, burner blocking and tempering risks.

CN 108006629A of "Combustor and Gas Water Heater With Same" disclosed a combustor comprising a first rich combustion cavity, a second rich combustion cavity and a poor combustion cavity. However, one of the combustion units actually only forms one flame as a whole. The middle part of the flame is a lean burning flame and two sides of the flame are rich burning flames. Unburned fuel of the rich burning flame and surplus oxygen of the lean burning flame are converged at the tail end of the flame to subject to secondary combustion. The first blind path and the second blind path are arranged to separate the rich flame and the lean flame and cannot separate the whole flame.

In conclusion, the existing mature technology with low manufacturing cost of a burning assembly is high in pollutant emission and not beneficial to environmental protection; and a technology with relatively low pollutant emission is unfavorable for popularization due to overhigh manufacturing cost.

SUMMARY

According to the technical problem, it's an object of the present disclosure to provide a burner which having a desirable burning effect, less pollutants discharged and a low manufacturing cost, and the use thereof. The present disclosure employs the following technical solution:

A burner includes a housing, a fan, a burning head and an ignition mechanism, where the housing includes an air inlet, the air inlet and an input end of the burning head form a pressure equalizing cavity, the fan blows mixed gas of fuel gas and air through the burning head to uniformly mix the mixed gas, the ignition mechanism is arranged at an output end of the burning head and is used for igniting the mixed gas of the fuel gas and the air, the burning head includes a main frame and at least one stable burning isolation strip, an interior of the main frame is divided into at least two ventilation areas by the stable burning isolation strip in a gas channel direction, a plurality of separation mechanisms are arranged in each ventilation area and divide the ventilation area into a plurality of through holes distributed in the gas channel direction, the through holes are used for allowing the mixed gas to pass through and strengthening a mixing effect of the fuel gas and the air, and burning flames of a burning surface of the main frame can be separated to form mutually independent flames by means of the stable burning isolation strip.

Further, a micro-channel rectifier is arranged in the pressure equalizing cavity, and a secondary gas pressure equalizing mixing cavity is formed between the micro-channel rectifier and the burning head.

Further, the air outlet of the fan is connected to the air inlet of the housing, and a fuel gas outlet of a fuel gas pipeline is connected in front of the air inlet of the fan or behind the air outlet of the fan.

Further, the burner includes a smoke pipe, where an air inlet of the fan is connected to a smoke outlet of the housing, the smoke pipe is connected to the air outlet of the fan, and the fuel gas outlet of the fuel gas pipeline is connected behind the air inlet of the housing.

Further, the stable burning isolation strip is attached to a surface of the main frame, or penetrates the main frame in a thickness direction, or extends into the main frame by a preset length; the stable burning isolation strip is fixed on the main frame, and the ventilation areas are embedded in the main frame; alternatively, the ventilation areas are fixed on the main frame, and the stable burning isolation strip is attached to the main frame; and alternatively, the ventilation areas are fixed on the stable burning isolation strip, and the ventilation areas and the stable burning isolation strip are integrally fixed on the main frame, or an integral structure is integrally formed.

Further, a single through hole has a cross-sectional area $S_{hole}$ satisfying $0.1\ mm^2 \leq S_{hole} \leq 9\ mm^2$; the ventilation areas are specifically formed by patches of continuous through holes, and each ventilation area has a cross-sectional area $S_n$ satisfying $30\ mm^2 \leq S_n \leq 22500\ mm^2$. A hole wall thickness, that is, a thickness $d_{hole}$ of the separation mechanism satisfies $0.03\ mm \leq d_{hole} \leq 3\ mm$, and the main frame has a wall thickness $d_{outer}$ satisfying $0.03\ mm \leq d_{outer} \leq 50\ mm$. The ventilation areas have a thickness/height h satisfying $4\ mm \leq h \leq 1000\ mm$. The stable burning isolation strip has a width $D_1$ equal to a total length of three to ten through holes, and satisfying $2\ mm \leq D_1 \leq 50\ mm$. The stable burning isolation strip is continuous or discontinuous, and a discontinuous section has a width $D_2$ equal to a total length of one or two through holes.

It's another object of the present disclosure to provide a gas stove including the burner, where the housing includes an inner-ring burner housing and an outer-ring burner housing, the burning head includes an outer-ring burning head and an inner-ring burning head, the outer-ring burning head is arranged in the outer-ring burner housing, the inner-ring burning head is arranged in the inner-ring burner housing, a preset distance is provided between the inner-ring burning head and the outer-ring burning head. The fuel gas channel includes a main pipeline, and an inner-ring burner fuel gas pipe and an outer-ring burner fuel gas pipe which are connected to the main pipeline, fuel gas output from the inner-ring burner fuel gas pipe enters an input end of the inner-ring burner burning head by means of an inner-ring burner fuel gas distribution structure, and fuel gas output from the outer-ring burner fuel gas pipe enters an input end of the outer-ring burner burning head by means of an outer-ring burner fuel gas distribution structure.

It's another object of the present disclosure to provide a low-nitrogen burning machine for a gas boiler including the burner.

It's another object of the present disclosure to provide a gas water heater including the burner, where the smoke pipe is connected to the output end of the burning head and a burning cavity is formed therebetween, a heat exchanger is arranged in the burning cavity for absorbing heat of high-temperature smoke in the burning cavity and transferring the heat to water in a coil pipe, and the smoke pipe is in connection with the smoke outlet of the housing.

It's another object of the present disclosure to provide a gas-fired heating and hot water combi-boiler including the burner, where the smoke pipe is connected to the output end of the burning head and a burning cavity is formed therebetween, a main heat exchanger is arranged in the burning cavity for absorbing heat of high-temperature smoke in the burning cavity and transferring the heat to water in a coil pipe, a secondary heat exchanger is used for transferring heat of primary heat exchange water from the main heat exchanger to secondary heat exchange water, and the smoke pipe is connected to the smoke outlet of the housing.

In the present disclosure, power of the burning component may be changed along with an area of the burner. The gas and the air enter a micro-channel to be thoroughly and uniformly mixed and then ignited to form uniform premixed flames after being sprayed out of the micro-channel. Since the isolation strip is arranged, the flames are independent of each other, each separated flame is of a pyramid-like shape (a flame surface is of a hollow cone shape), and the flames are stable, so that an erratic continuous flame is effectively avoided, and the burning is stable. Meanwhile, pore density of the micropores is large, and the pore diameter is limited. Limited space in the micropores has a rectification effect, mixing the fuel gas and the air well, so that CO and $NO_x$ emission is very low and is 10 ppm or below, which is clean and efficient. Further, the arrangement of the micropores has an anti-backfire function. A micro-channel structure in the field of catalyst carriers is applied to the field of burning, such that no large-specification transformation of an existing appliance is needed, thus the cost is reduced.

BRIEF DESCRIPTION OF THE DRAWINGS

In order to more clearly illustrate technical solutions in the embodiments of the present disclosure or in the prior art, a brief introduction to the accompanying drawings required for the description of the embodiments or the prior art will be provided below. Obviously, the accompanying drawings in the following description are some of the embodiments of the present disclosure, and those ordinary skilled in the art would also be able to derive other drawings from these drawings without making creative efforts.

FIG. 11 is a comparison diagram of a specific embodiment using the present disclosure to the prior art.

IN THE FIGURES

1. housing; 2. air distributor; 3. micro-channel rectifier; 4. burning head; 5. ignition needle; 6. air inlet; 7. pressure equalizing cavity; 8. secondary gas pressure equalizing mixing cavity; 9. flame; 10. fuel gas valve; 11. main frame; 12. through hole; 13. stable burning isolation strip; 14. smoke outlet; 15. gas mixing structure; 16. burning cavity; 17. heat exchanger; 18. smoke pipe; 19. flow guide mechanism; 101. inner-ring burner housing; 102. inner-ring burner fuel gas pipe; 103. inner-ring burner fuel gas distribution structure; 104. inner-ring (burner) burning head; 201. outer-ring burner housing; 202. outer-ring burner fuel gas pipe; 203. outer-ring burner fuel gas distribution structure; 204. outer-ring (burner) burning head; 111. controller; 112. fan; 118. flame detector; 901. main heat exchanger; 902. secondary heat exchanger; and 903. circulating water pump.

DETAILED DESCRIPTION OF THE EMBODIMENTS

To make the objectives, technical solutions and advantages of embodiments of the present disclosure more obvious, the technical solutions of the present disclosure will be clearly and completely described below in conjunction with the accompanying drawings in the embodiments of the present disclosure, and obviously, the described embodiments are some, rather than all of the embodiments of the present disclosure. Based on the embodiments of the present disclosure, all other embodiments acquired by those of ordinary skill in the art without making creative efforts fall within the scope of protection of the present disclosure.

Figure 1:
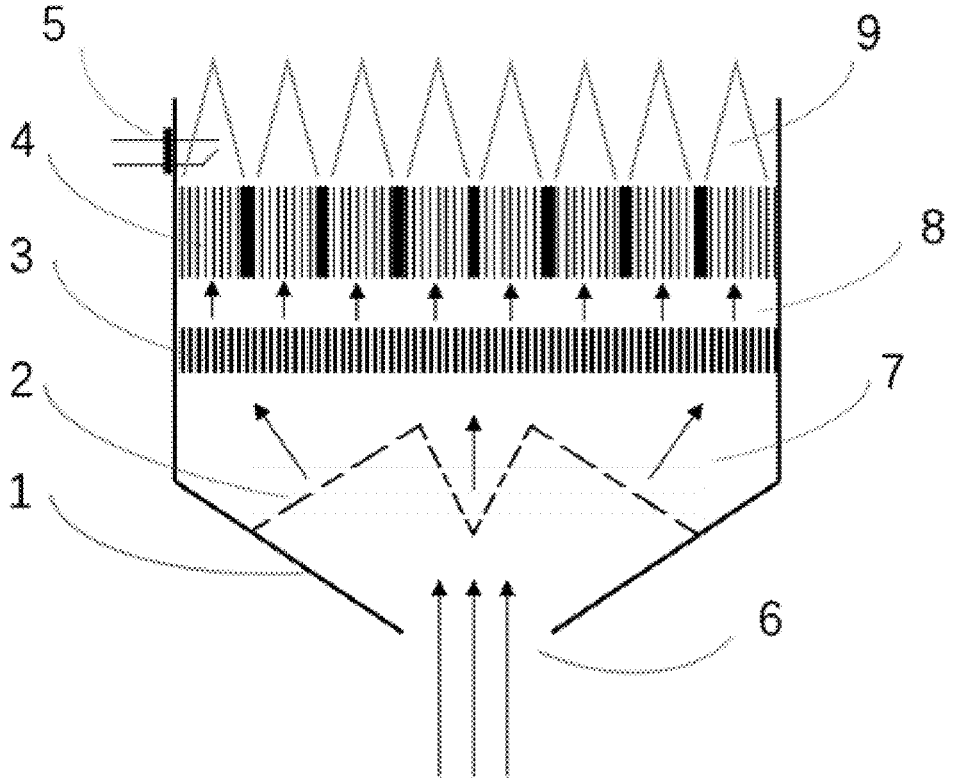
FIG. 1 is a structural schematic diagram of a burner in an embodiment of the present disclosure.

As shown in FIG. 1, disclosed in the embodiment is a burner. The burner includes a housing, a fan, a burning head and an ignition mechanism. The housing 1 includes an air inlet 6, and the air inlet and an input end of the burning head form a pressure equalizing cavity 7. The fan blows mixed gas of fuel gas and air through the burning head to uniformly mix the mixed gas. The ignition mechanism is arranged at an output end of the burning head 4 and is used for igniting the mixed gas of the fuel gas and the air. In this embodiment, the ignition mechanism may be an ignition needle 5. The burning head includes a main frame and at least one stable burning isolation strip 13. An interior of the main frame 11 is divided into at least two ventilation areas by the stable burning isolation strip in a gas channel direction, and a plurality of separation mechanisms are arranged in each ventilation area and divide the ventilation area into a plurality of through holes 12 distributed in the gas channel direction. The through holes are used for allowing mixed gas to pass through and strengthening a mixing effect of fuel gas and air, burning flames of a burning surface of the main frame may be separated to form mutually independent flames by means of the stable burning isolation strip. The fuel gas passing through a micro-channel rectifier is ignited to form a hollow conical flame 9.

By means of an air distributor 2 arranged between the air inlet 6 of the housing and the burning head 4 or between the air inlet 6 of the housing and the micro-channel rectifier 3, the fuel gas and the air are uniformly distributed, and an outlet of the mixed gas of the fuel gas and air is an outlet of the micro-channel rectification burner. A micro-channel rectifier 3 is further arranged in the pressure equalizing cavity, so as to form a secondary gas pressure equalizing mixing cavity 8 to obtain a better rectification effect.

In some implementation modes, an air outlet of the fan is connected to an air inlet of the housing, and a fuel gas outlet of a fuel gas pipeline is connected in front of an air inlet or behind the air outlet of the fan.

In other optional implementation modes, the burner further includes a smoke pipe, where the air inlet of the fan is connected to a smoke outlet of the housing, the smoke pipe is connected to the air outlet of the fan, and the fuel gas outlet of the fuel gas pipeline is connected behind the air inlet of the housing. The fan 112 is used for providing combustion air.

The stable burning isolation strip is attached to a surface of the main frame, or penetrates the main frame in a thickness direction, or extends into the main frame by a preset length; the stable burning isolation strip is fixed on the main frame, and the ventilation areas are embedded in the main frame; alternatively, the ventilation areas are fixed on the main frame, and the stable burning isolation strip is attached to the main frame; and alternatively, the ventilation areas are fixed on the stable burning isolation strip, and the ventilation areas and the stable burning isolation strip are integrally fixed on the main frame, or an integral structure is integrally formed.

In a process that fuel gas is input into the gas channel in the main frame by an air blower/exhaust fan, there are many directions for the entering gas. Under the condition that the area of ventilation areas is too large, a flame connecting phenomenon is prone to occurring, and therefore the single ventilation area having an area small enough is required. When the embodiment is used in various fields, the cross-sectional area of the single through hole may be different, but it should be guaranteed that the single through hole has a cross-sectional area $S_{hole}$ satisfying $0.1\ mm^2 \leq S_{hole} \leq 9\ mm^2$. According to different manufacturing processes or other possible influencing factors, a certain defective rate, non-uniform pore sizes, or specifications of a certain number of pores exceeding a range of the present disclosure may be considered to be within the scope of protection of the present disclosure.

The ventilation areas have a thickness/height h satisfying 4 mm≤h≤1000 mm. Different through holes may have equal heights or not, upper surfaces and lower surfaces of the holes may be planar or not, but it needs to be guaranteed that after entering the micropores, the mixed gas of fuel gas and air may continuously collide at the pore walls of the micropores and mix due to limitation of a pore volume, and then a output direction of the fuel gas at the output end of the gas channel is a straight line. The micropores have an effect of mixing and rectification in the process, such that the burning efficiency of the flame is further enhanced.

The stable burning isolation strip has a width $D_1$ satisfying 2 mm≤$D_1$≤50 mm.

The ventilation area is formed by patches of continuous through holes, and each ventilation area has a cross-sectional area $S_n$ satisfying 30 $mm^2 \leq S_n \leq 22500$ $mm^2$.

A hole wall thickness, that is, a thickness $d_{hole}$ of the separation mechanism satisfies 0.03 mm≤$d_{hole}$≤3 mm, and the main frame has a wall thickness satisfying 0.03 mm≤$d_{outer}$≤50 mm.

Figure 2:
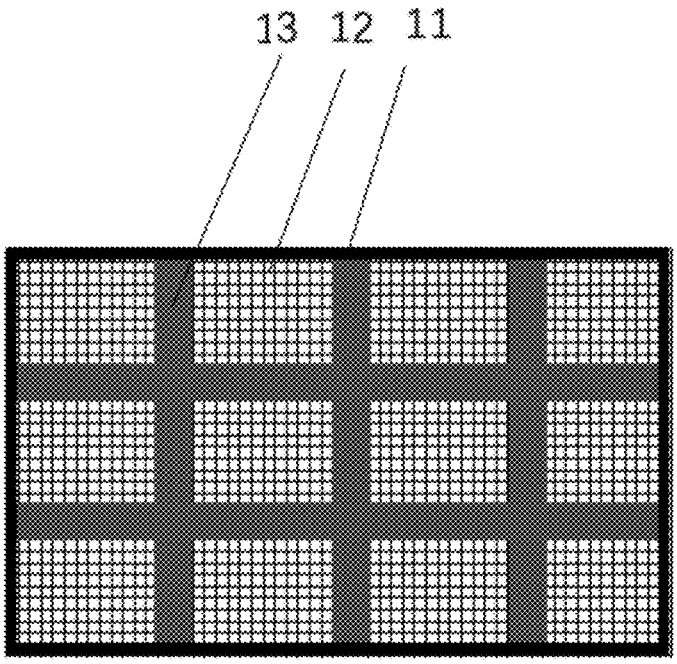
FIG. 2 is a simple structural schematic diagram of a burning head of Embodiment 1 of the present disclosure.
Figure 6:
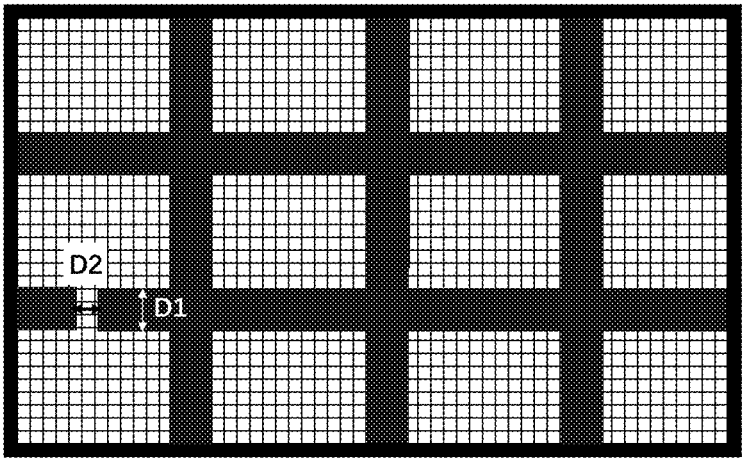
FIG. 6 is a schematic diagram illustrating a non-continuous state of a stable burning isolation strip in an embodiment of the present disclosure.

FIG. 2 shows a shape of a burning component of Embodiment 1. The main frame is rectangular, and the internal stable burning isolation strips are elongated shape, which divides the interior of the rectangle into a plurality of uniform areas, and the flames of adjacent pores are of pyramid-like shape (flame surfaces are of hollow cone shape). As shown in FIG. 6, in other optional embodiments, the areas divided in the interior of the rectangle may be different in area, the stable burning isolation strip may also be discontinuous, but it needs to be guaranteed that the stable burning isolation strip has a width $D_1$ equal to a total length of three to ten through holes and a discontinuous section has a width $D_2$ equal to a total length of one or two through holes. The separation mechanism may be of an illustrated linear type or other regular or irregular shapes, but the separation mechanism is needed.

Figure 3:
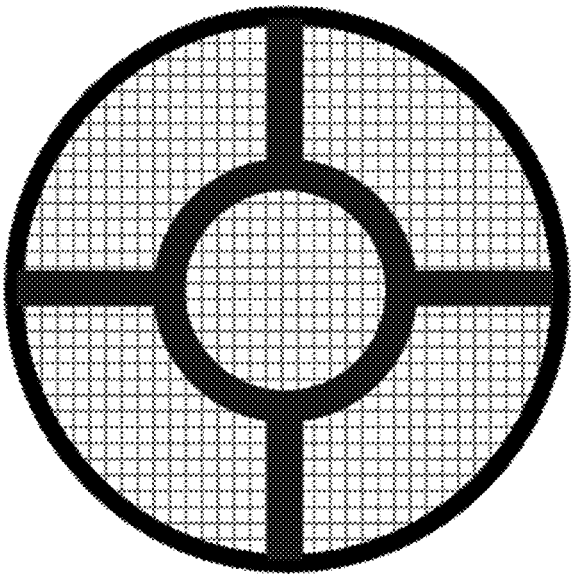
FIG. 3 is a simple structural schematic diagram of a burning head of Embodiment 2 of the present disclosure.

FIG. 3 shows a shape of a burning component of Embodiment 2. The main frame is circular, and the internal stable burning isolation strip is circular. The outer circle is in connection with the main frame by means of a plurality of stable burning isolation strips so as to divide the area into a preset shape.

Figure 4:
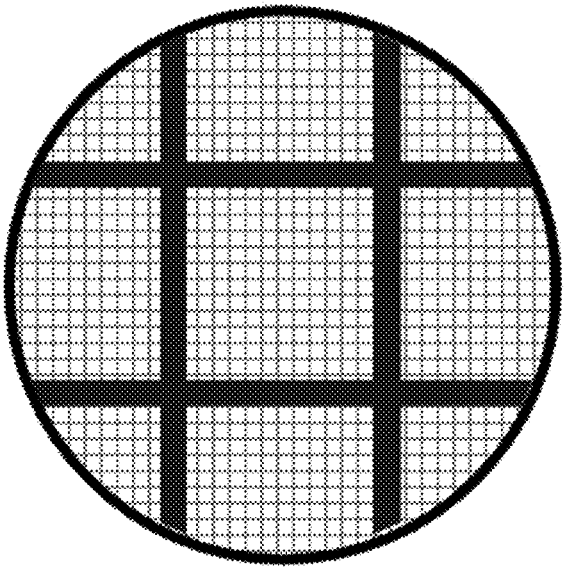
FIG. 4 is a simple structural schematic diagram of a burning head of Embodiment 3 of the present disclosure.

FIG. 4 shows a shape of a burning component of Embodiment 3. The main frame is circular, and the interior thereof is divided by a plurality of stable burning isolation strips.

Figure 5:
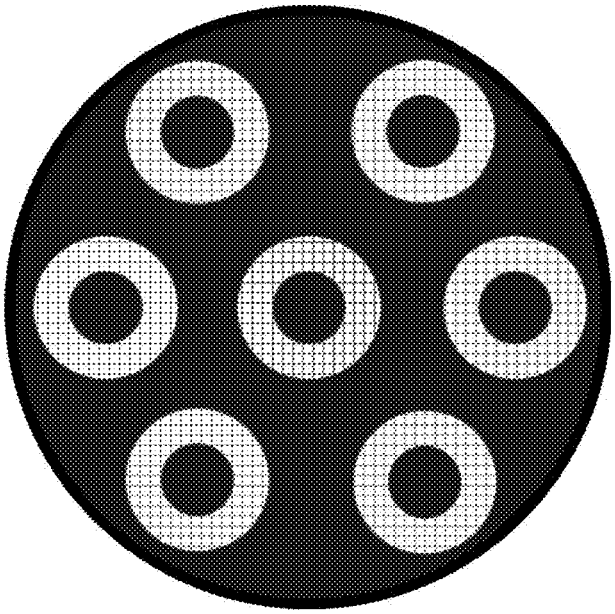
FIG. 5 is a simple structural schematic diagram of a burning head of Embodiment 4 of the present disclosure.

FIG. 5 shows a shape of a burning component of Embodiment 4. The main frame is circular, the ventilation area is annular, and the interior is divided by a plurality of stable burning isolation strips.

The stable burning isolation strip may be arranged in various modes, for example, the stable burning isolation strip is attached to a surface of the main frame, or penetrates the main frame in a thickness direction, or extends into the main frame by a preset length. Its main purpose is to separate the main frame. In a traditional process that fuel gas is input into the gas channel in the main frame by an air blower/exhaust fan, due to spiral action of the fan, the output air is high in flow speed in a local area and low in flow speed in another local area, causing an erratic flame, and therefore burning is incomplete. In the present disclosure, the main frame is divided into a plurality of areas by the stable burning isolation strips. Although burning powers of the adjacent areas are still different, the adjacent flames may be unaffected, so as to achieve stable burning.

Materials of the burning component include non-metal material and metal material. For example, the non-metal material may be honeycomb ceramic, and it is to be noted that an use principle of an existing honeycomb ceramic porous burner is intra-hole burning, which is different from a principle of the present disclosure (as for a honeycomb ceramic porous structure, burning is firstly carried out in a flame form, after a ceramic plate is heated by the flame, burning returns to porous channels and is completed in the porous channels; and the burner is in a red hot state and generates a large amount of infrared radiation, and is also called an infrared burner; and the burner is prone to burst after being rapidly cooled and rapidly heated, burning power is limited, and the burner cannot be used as a high-power heater).

Figure 7:
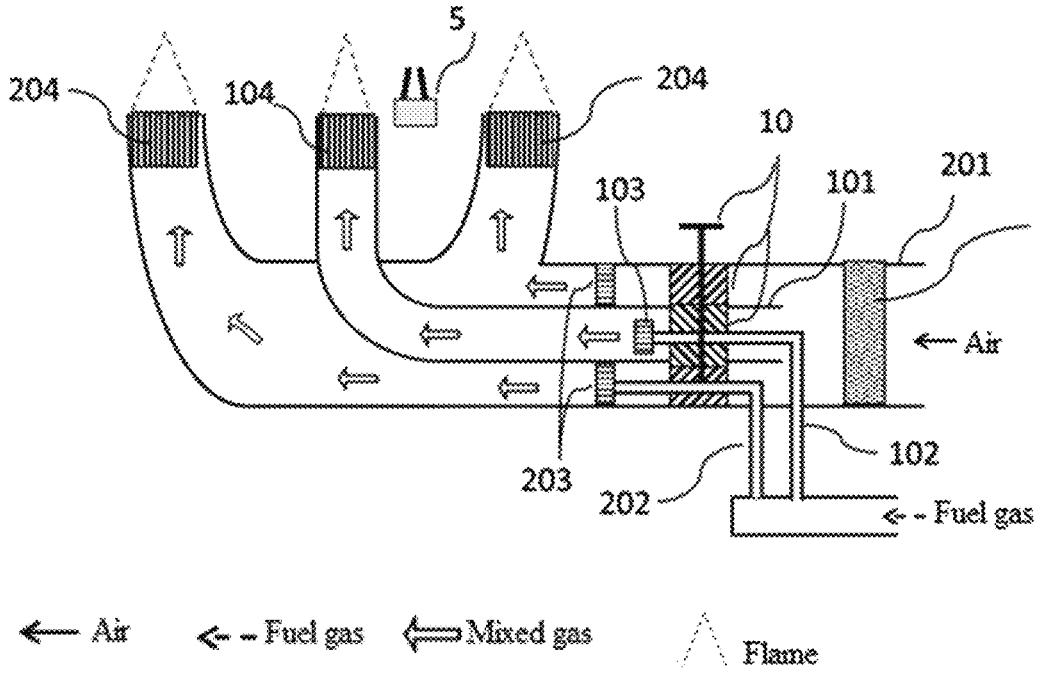
FIG. 7 is a structural schematic diagram of a gas stove in Embodiment 5 of the present disclosure.

FIG. 7 shows an implementable gas stove in this embodiment. The gas stove includes the burner of the present disclosure, where the housing includes an inner-ring burner housing and an outer-ring burner housing, the burning head includes an outer-ring burning head and an inner-ring burning head, the outer-ring burning head 204 is arranged in the outer-ring burner housing 201, the inner-ring burning head 104 is arranged in the inner-ring burner housing 101, a preset distance is provided between the inner-ring burning head and the outer-ring burning head, the fuel gas channel includes a main pipeline, and an inner-ring burner fuel gas pipe 102 and an outer-ring burner fuel gas pipe 202 which are connected to the main pipeline, fuel gas output from the inner-ring burner fuel gas pipe enters an input end of the inner-ring burner burning head by means of an inner-ring burner fuel gas distribution structure 103, fuel gas output from the outer-ring burner fuel gas pipe enters an input end of the outer-ring burner burning head by means of an outer-ring burner fuel gas distribution structure 203, and a fuel gas valve 10 may adjust both gas inlet amount of the fuel gas and an air inlet amount of the air.

Figure 8:
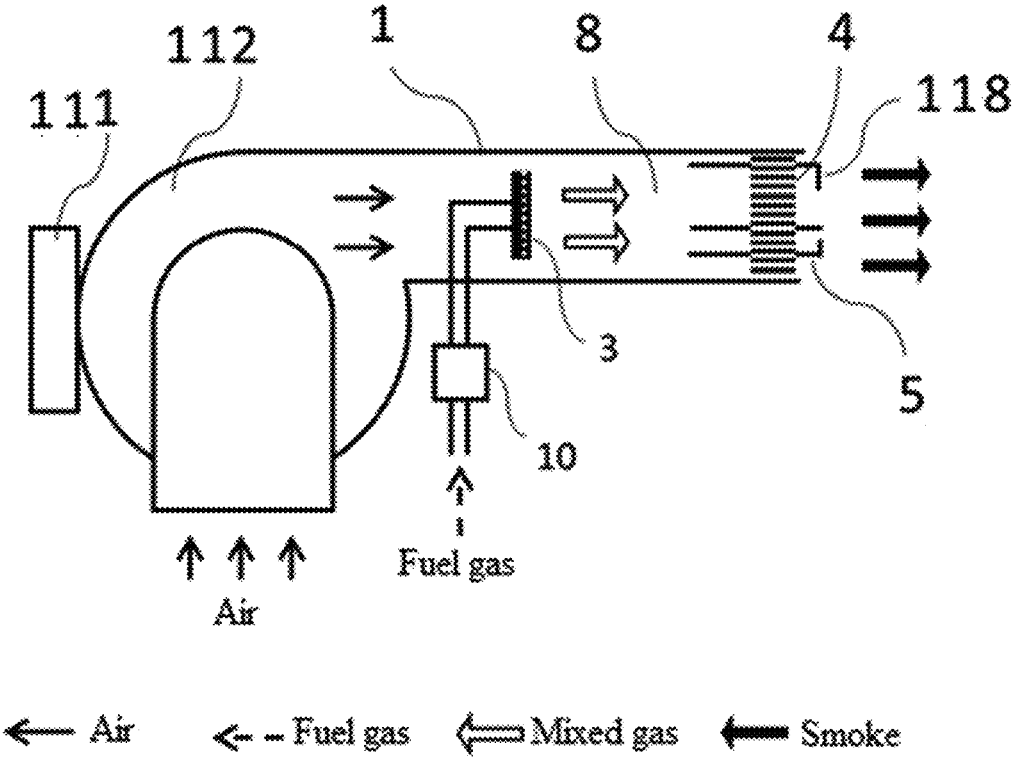
FIG. 8 is a structural schematic diagram of a low-nitrogen burning machine for a gas boiler in Embodiment 6 of the present disclosure.

FIG. 8 shows an implementable low-nitrogen burning machine for a gas boiler in the embodiment. The low-nitrogen burning machine includes a controller 111, a fan, a fuel gas valve, a fuel gas distribution mechanism, a gas mixing cavity housing, a burning head, an ignition needle and a flame detector. The fan 112 is used for providing air required by burning, the fuel gas valve 10 is used for controlling on-off and flow of fuel gas, the fuel gas distribution mechanism may be a micro-channel rectifier for evenly distributing the fuel gas on a cross section of an air channel, the gas mixing cavity is used for mixing the fuel gas with air, the ignition needle is arranged at the output end of the burning head for igniting the premixed gas of the air and the fuel gas, the flame detector 118 is arranged at the output end of the burning head for detecting a flame signal, and the controller 1 is used for controlling the fan, the fuel gas valve, the ignition needle and the flame detector.

In the embodiment, one end of the fuel gas distribution mechanism is in connection with the fuel gas valve 10, the other end is arranged in the gas mixing cavity housing 1 connected to the air outlet of the fan. The fuel gas distribution mechanism is of a disc shape; in other optional implementations, the fuel gas distribution mechanism may be of other implementable shapes such as a comb shape. The air and the fuel gas may be mixed in the mixing cavity housing or in the fan.

Figure 9:
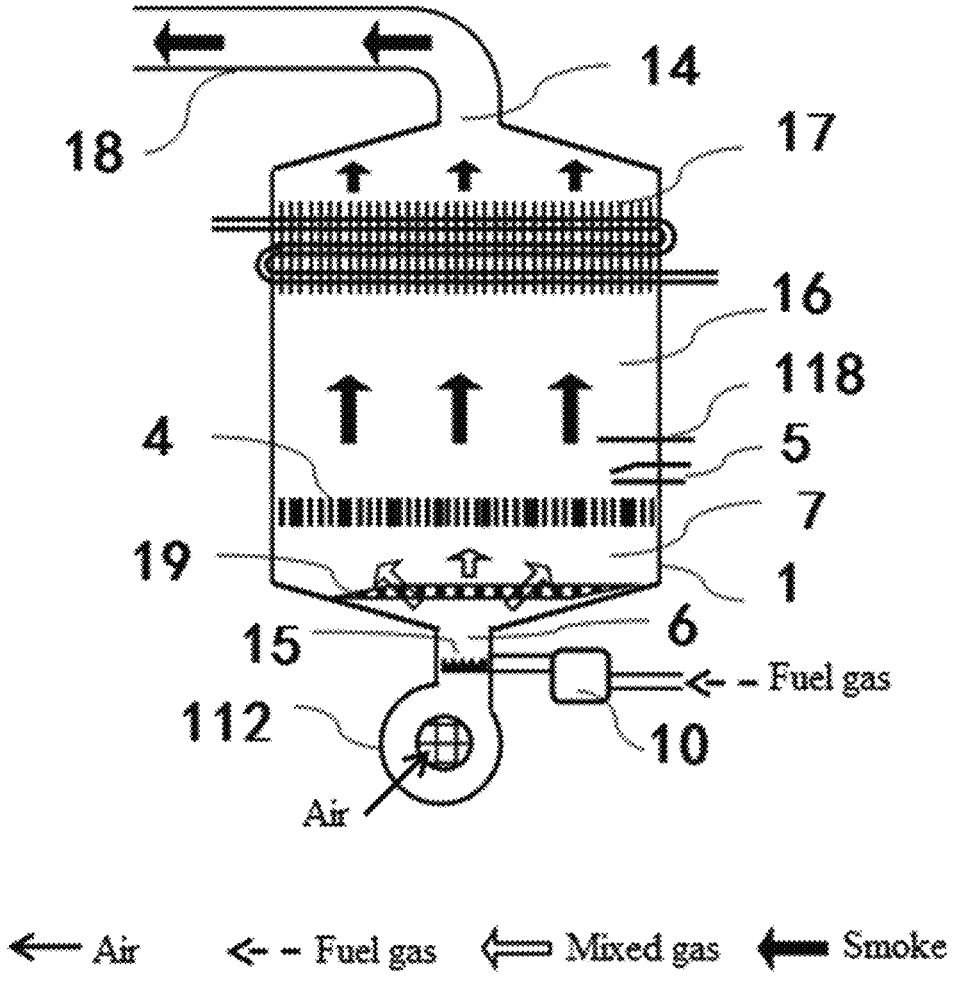
FIG. 9 is a structural schematic diagram of a gas water heater in Embodiment 7 of the present disclosure.

FIG. 9 shows an implementable gas water heater in the embodiment. The gas water heater includes the burner of the present disclosure, where the housing 1 is provided with an air (gas) inlet 6 and a smoke outlet 14. In this embodiment, a bottom of the housing has a certain inclined angle, a flow guide mechanism 19 is arranged on the inclined plane, the air inlet is provided below the flow guide mechanism, a gas mixing structure 15 is arranged at the air inlet, the smoke pipe 18 is connected to the output end of the burning head and a burning cavity 16 is formed therebetween, a heat exchanger 17 is arranged in the burning cavity for absorbing heat of high-temperature smoke in the burning cavity and transferring the heat to water in a coil pipe, and the smoke pipe is in connection with the smoke outlet of the housing.

Figure 10:
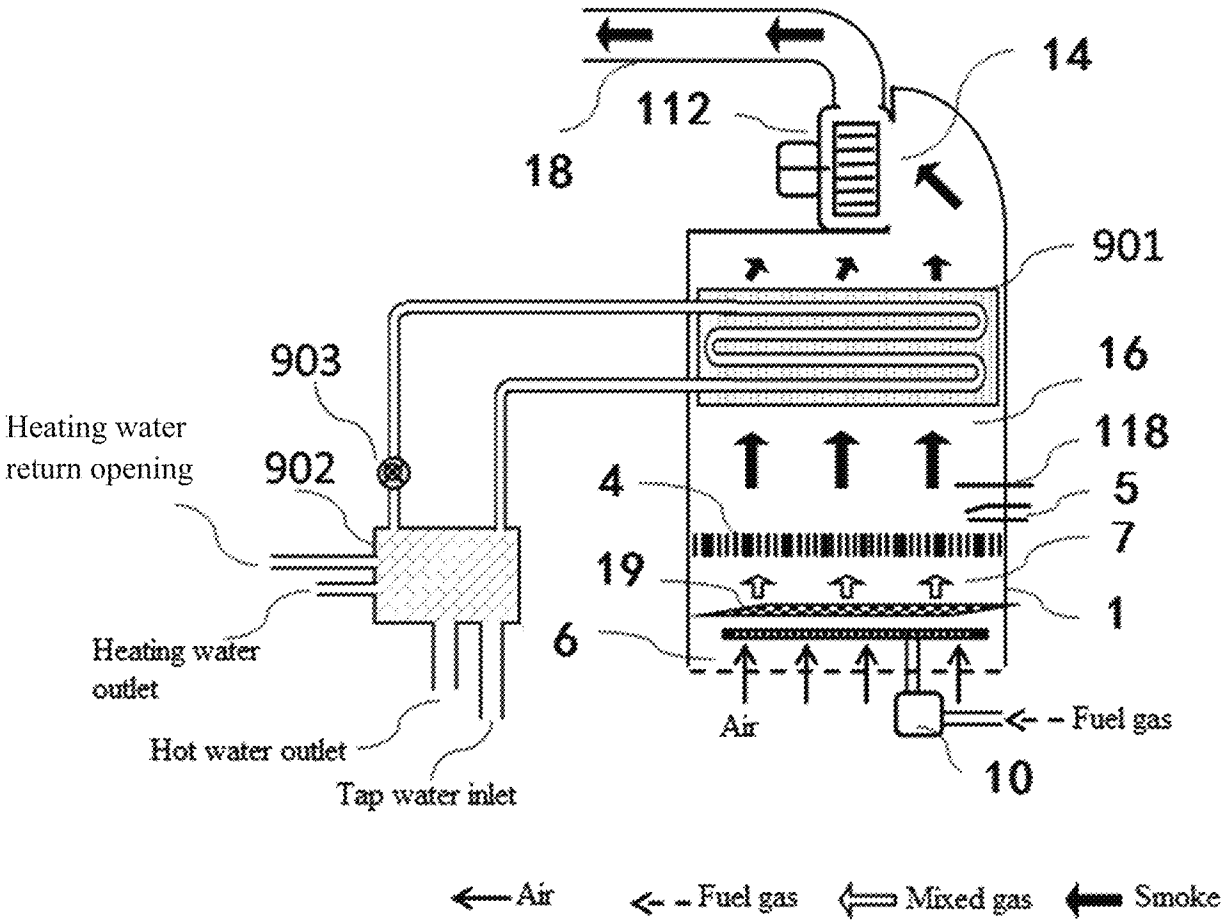
FIG. 10 is a structural schematic diagram of a gas-fired heating and hot water combi-boiler in Embodiment 8 of the present disclosure.

FIG. 10 is an implementable gas-fired heating and hot water combi-boiler in the embodiment. Similar to the gas water heater disclosed in FIG. 9, the embodiment includes the burner of the present disclosure, where the smoke pipe is connected to the output end of the burning head and a burning cavity is formed therebetween, a main heat exchanger 901 is arranged in the burning cavity for absorbing heat of high-temperature smoke in the burning cavity and transferring the heat to water in a coil pipe, water in a pipeline of the main heat exchanger is driven by a circulating water pump 903 to internally circulate, and a secondary heat exchanger 902 is used for transferring heat of primary heat exchange water from the main heat exchanger to secondary heat exchange water. In the embodiment, the secondary heat exchanger is provided with a tap water inlet and water outlets, for example, a hot water outlet, a heating water outlet and a heating water return opening. The smoke pipe is connected to the smoke outlet of the housing.

As may also be seen from a comparison diagram in FIG. 11, the burning flame in the present disclosure is blue, and the adjacent flames burn stably. FIG. 11 further shows a pollutant emission amount measured by means of experiments. An emission standard of a gas boiler in China is that a nitrogen oxide emission amount≤200 mg/m$^3$, the standard in some regions is higher, for example, ≤80 mg/m$^3$ or ≤30 mg/m$^3$; and the nitrogen oxide emission amount in the present disclosure is ≤15 mg/m$^3$. The present disclosure has a low overall manufacturing cost and low pollutant emission. In actual production and life, the present disclosure may be used in various fields related to fuel gas, for example, gas stoves, gas water heaters, gas boilers, gas wall-hanging stoves, etc., and have a desirable effect of reducing pollutant emission.

At last, it should be noted that the above various embodiments are merely intended to illustrate the technical solution of the present disclosure and not to limit the same; although the present disclosure has been described in detail with reference to the foregoing embodiments, it should be understood by those ordinary skilled in the art that the technical solutions described in the foregoing embodiments may be modified or equivalents may be substituted for some or all of the technical features thereof; and the modification or substitution does not make the essence of the corresponding technical solution deviate from the scope of the technical solution of each embodiment of the present disclosure.

The invention claimed is:

1. A burner comprising a housing, a fan, a burning head and an ignition mechanism, wherein:

the housing comprises an air inlet, the air inlet and an input end of the burning head form a pressure equalizing cavity;

the fan blows a mixed gas comprising a fuel gas and air through the burning head to uniformly mix the mixed gas;

the ignition mechanism is arranged at an output end of the burning head and is configured to ignite the mixed gas;

the burning head comprises a main frame and at least one stable burning isolation strip;

an interior of the main frame is divided into at least two ventilation areas by the at least one stable burning isolation strip in a gas channel direction;

a plurality of separation mechanisms are arranged in each ventilation area and divide each ventilation area into a plurality of through holes; and the plurality of through holes are configured to allow the mixed gas to pass through;

wherein:

one or more of the at least one stable burning isolation strip is attached to a surface of the main frame, or penetrates the main frame in a thickness direction, or extends into the main frame by a preset length and one or more of the at least two ventilation areas are embedded in the main frame, or one or more of the at least two ventilation areas and one or more of the at least one stable burning isolation strip are integrally fixed on the main frame, or one or more of the at least two ventilation areas and one or more the at least one stable burning isolation strip form an integral structure;

each through hole has a cross-sectional area $S_{hole}$ satisfying 0.1 mm$^2$≤$S_{hole}$≤9 mm$^2$;

each ventilation area comprises a plurality of through holes and has a cross-sectional area $S_n$ satisfying 30 mm$^2$≤$S_n$≤22500 mm$^2$;

a thickness $d_{hole}$ of each separation mechanism satisfies 0.03 mm≤$d_{hole}$≤3 mm;

the main frame has a wall thickness $d_{outer}$ satisfying 0.03 mm≤$d_{outer}$≤50 mm;

the ventilation areas have a height h satisfying 4 mm≤h≤1000 mm;

each stable burning isolation strip has a width $D_1$ equal to a total length of three to ten through holes, and satisfying 2 mm≤$D_1$≤50 mm; and the stable burning isolation strip is continuous or discontinuous, and a discontinuous section has a width $D_2$ that equals a total length of one or two through holes.

2. The burner according to claim 1, further comprises a micro-channel rectifier arranged in the pressure equalizing cavity, and a secondary gas pressure equalizing mixing cavity is formed between the micro-channel rectifier and the burning head.

3. The burner according to claim 1, wherein an air outlet of the fan is connected to the air inlet of the housing, and a fuel gas outlet of a fuel gas pipeline is connected to the burner upstream from the air inlet of the fan or downstream from the air outlet of the fan.

4. The burner according to claim 1, further comprising a smoke pipe, wherein the air inlet of the fan is connected to a smoke outlet of the housing, the smoke pipe is connected to the air outlet of the fan, and the fuel gas outlet of the fuel gas pipeline is connected to the burnder downstream from the air inlet of the housing.

5. A gas stove comprising the burner according to claim 1, wherein the housing comprises an inner-ring burner housing and an outer-ring burner housing, the burning head comprises an outer-ring burning head and an inner-ring burning head, the outer-ring burning head is arranged in the outer-ring burner housing, the inner-ring burning head is arranged in the inner-ring burner housing, a preset distance is provided between the inner-ring burning head and the outer-ring burning head; the fuel gas channel comprises a main pipeline, and an inner-ring burner fuel gas pipe and an outer-ring burner fuel gas pipe which are connected to the main pipeline, fuel gas output from the inner-ring burner fuel gas pipe enters an input end of the inner-ring burner burning head by means of an inner-ring burner fuel gas distribution structure, and fuel gas output from the outer-ring burner fuel gas pipe enters an input end of the outer-ring burner burning head by means of an outer-ring burner fuel gas distribution structure.

6. A low-nitrogen burning machine for a gas boiler comprising the burner according to claim 1.

7. A gas water heater comprising the burner according to claim 1, wherein the smoke pipe is connected to the output end of the burning head and a burning cavity is formed therebetween, a heat exchanger is arranged in the burning cavity for absorbing heat of high-temperature smoke in the burning cavity and transferring the heat to water in a coil pipe, and the smoke pipe is in connection with the smoke outlet of the housing.

8. A gas-fired heating and hot water combi-boiler comprising the burner according to claim 1, wherein the smoke pipe is connected to the output end of the burning head and a burning cavity is formed therebetween, a main heat exchanger is arranged in the burning cavity for absorbing heat of high-temperature smoke in the burning cavity and transferring the heat to water in a coil pipe, a secondary heat exchanger is used for transferring heat of primary heat exchange water from the main heat exchanger to secondary heat exchange water, and the smoke pipe is connected to the smoke outlet of the housing.

* * * * *